US010207282B2

(12) United States Patent
Cheng et al.

(10) Patent No.: US 10,207,282 B2
(45) Date of Patent: Feb. 19, 2019

(54) WASH-FREE AIR-GUIDING COVER FOR A PAINT CONTAINER

(71) Applicants: Hung-Yen Cheng, Taoyuan (TW); Kai-Cheng Chang, Taoyuan (TW)

(72) Inventors: Hung-Yen Cheng, Taoyuan (TW); Kai-Cheng Chang, Taoyuan (TW)

( * ) Notice: Subject to any disclaimer, the term of this patent is extended or adjusted under 35 U.S.C. 154(b) by 286 days.

(21) Appl. No.: 15/201,642

(22) Filed: Jul. 5, 2016

(65) Prior Publication Data

US 2018/0009581 A1 Jan. 11, 2018

(51) Int. Cl.
*B65D 47/32* (2006.01)
*B05B 7/24* (2006.01)

(52) U.S. Cl.
CPC ..... *B05B 7/2478* (2013.01); *B05B 7/2408* (2013.01)

(58) Field of Classification Search
CPC ..... B65D 47/32; B05B 7/2478; B44D 3/127
USPC ..... 220/373, 374, 367.1
See application file for complete search history.

(56) References Cited

U.S. PATENT DOCUMENTS 8,857,649 B2 * 10/2014 Buchholz ..... B05B 7/2478 220/367.1
2013/0292493 A1 * 11/2013 Marsalek ..... B05B 11/0016 239/379
2014/0103143 A1 * 4/2014 Lin ..... B05B 7/2408 239/379

* cited by examiner

*Primary Examiner* — Jeffrey Allen
(74) *Attorney, Agent, or Firm* — Alan D. Kamrath; Kamrath IP Lawfirm, P.A.

(57) ABSTRACT

A wash-free air-guiding cover includes a cover having a body with a fixing seat disposed on a side thereof. A ventilation tube is disposed on the fixing seat and includes a ventilation hole intercommunicated with the other side of the body. An air guiding device is mounted to the fixing seat and includes a tube having first, second, and third air guiding spaces. The air guiding device further includes first and second sealing members and first and second flow guiding rods. Air flowing into the tube must flow zigzag through the first, second, and third air guiding spaces and between the first and second flow guiding rods and the second and third air guiding spaces, assuring smooth flow of air during the painting operation and avoiding the paint from leaking via the ventilation tube and the ventilation hole of the cover.

6 Claims, 10 Drawing Sheets

WASH-FREE AIR-GUIDING COVER FOR A PAINT CONTAINER

BACKGROUND OF THE INVENTION

The present invention relates to a wash-free air-guiding cover for a paint container and, more particularly, to an air-guiding cover mounted to a paint container of a paint spray gun for preventing paint in the paint container from leaking via air vents.

A paint spray gun is generally connected to a wash-free paint container when in use. To keep smooth flow of the paint in the paint container, air valves are provided in a cup or a cover of the paint container. However, the paint spray gun could be in any orientation during the paint spraying operation, such that the paint in the paint container could leak via the air valves. Furthermore, the cover with air valves cannot permit smooth ventilation for the air inside and outside the paint container, leading to unstable output of the paint and leakage of the paint via the air valves.

Thus, a need exists for a novel cover for a paint container that mitigates and/or obviates the above disadvantages.

BRIEF SUMMARY OF THE INVENTION

The primary objective of the present invention is to provide a wash-free air-guiding cover including an air guiding device having a tube with first, second, and third air guiding spaces, first and second sealing members, and first and second flow guiding rods, such that air flowing into the tube must flow zigzag through the first, second, and third air guiding spaces and between the first and second flow guiding rods and the second and third air guiding spaces, assuring smooth flow of air during the painting operation and avoiding the paint from leaking via the ventilation tube and the ventilation hole of the cover. Thus, the smooth flow of air permits uniform atomization of the paint, avoids waste of the paint, and increases the painting quality.

A wash-free air-guiding cover according to the present invention includes a cover and an air guiding device. The cover includes a body having a first side and a second side. A fixing seat is disposed on the first side of the body. A ventilation tube extends from an inside of the fixing seat and includes a ventilation hole intercommunicated with the second side of the body. The air guiding device is mounted to the fixing seat of the cover. The air guiding device includes a tube, a first sealing member, and a second sealing member. The tube includes first and second ends and first, second, and third air guiding spaces. Each of the first, second, and third air guiding spaces extends from the first end through the second end of the tube. The first end of the tube includes a first positioning space intercommunicated with the first and second air guiding spaces. The second end of the tube includes a second positioning space intercommunicated with the second and third air guiding space. The first sealing member includes a first sealing element positioned in the first positioning space. A first flow guiding rod extends from a side of the first sealing element and extends into the second air guiding space. The second sealing member includes a second sealing element positioned in the second positioning space. A second flow guiding rod extends from a side of the second sealing element and extends into the third air guiding space. The first air guiding space intercommunicates with the ventilation tube and the ventilation hole of the cover.

Ambient air is permitted to enter the first air guiding space, pass through a gap between the second air guiding space and the first flow guiding rod via an end of the first air guiding space, pass through a gap between the third air guiding space and the second flow guiding rod via an end of the second air guiding space, and then flow out of an end of the third air guiding space.

The first end of the tube of the air guiding device can include a first groove intercommunicated between the first and second air guiding spaces and located adjacent to the first positioning space.

The second end of the tube of the air guiding device can include a second groove intercommunicated between the second and third air guiding spaces and located adjacent to the second positioning space.

The first flow guiding rod of the air guiding device can include a plurality of first guiding grooves disposed on an outer periphery of the first flow guiding rod and annularly spaced from each other.

The second flow guiding rod of the air guiding device can include a plurality of second guiding grooves disposed on an outer periphery of the second flow guiding rod and annularly spaced from each other.

The fixing seat of the cover can include a plurality of positioning recesses in an inner periphery thereof, and the tube of the air guiding device can include a plurality of positioning protrusions on the outer periphery thereof. Each of the plurality of positioning protrusions is engaged in one of the plurality of positioning recesses.

The present invention will become clearer in light of the following detailed description of illustrative embodiments of this invention described in connection with the drawings.

DETAILED DESCRIPTION OF THE INVENTION

Figure 1:
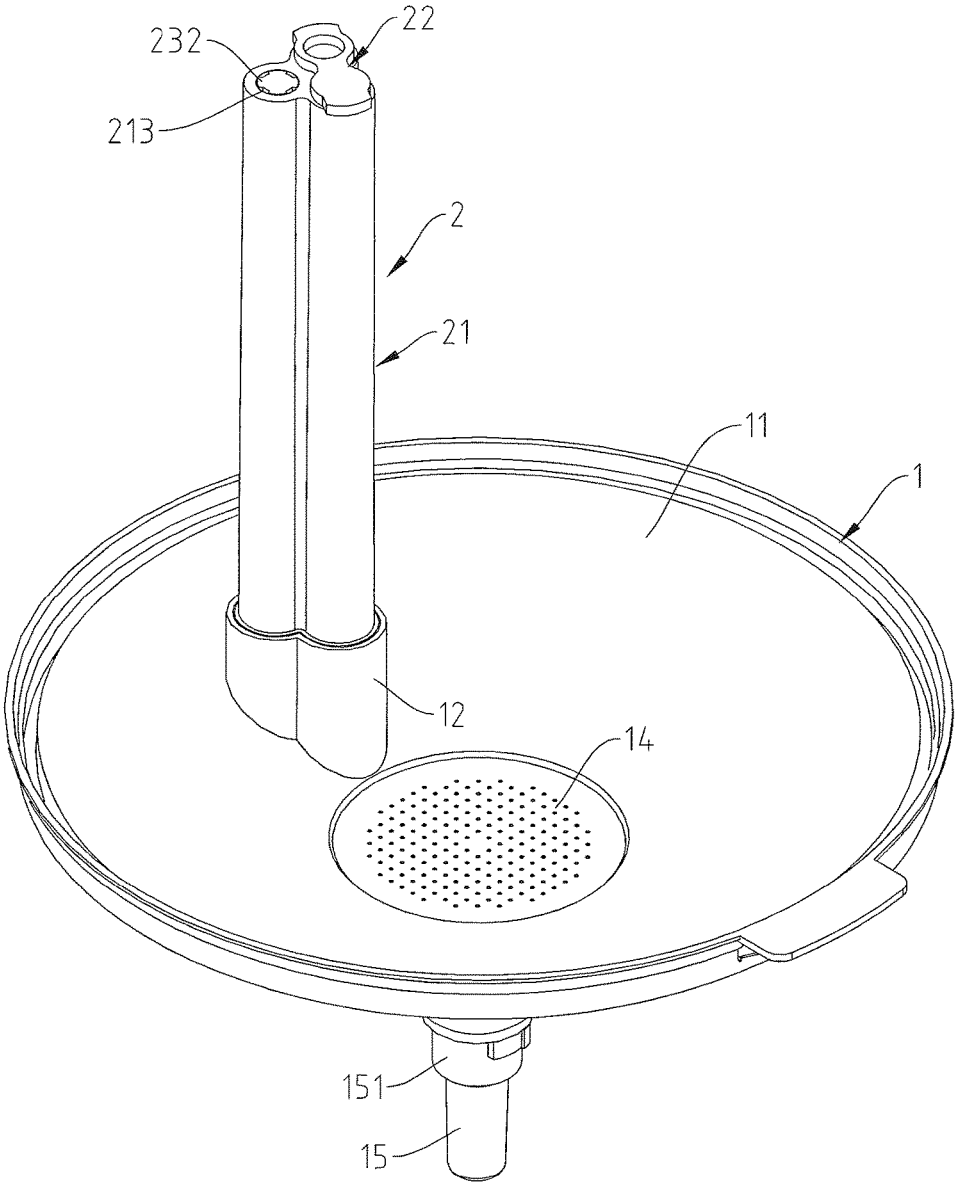
FIG. 1 is a perspective view of a wash-free air-guiding cover according to the present invention.
Figure 2:
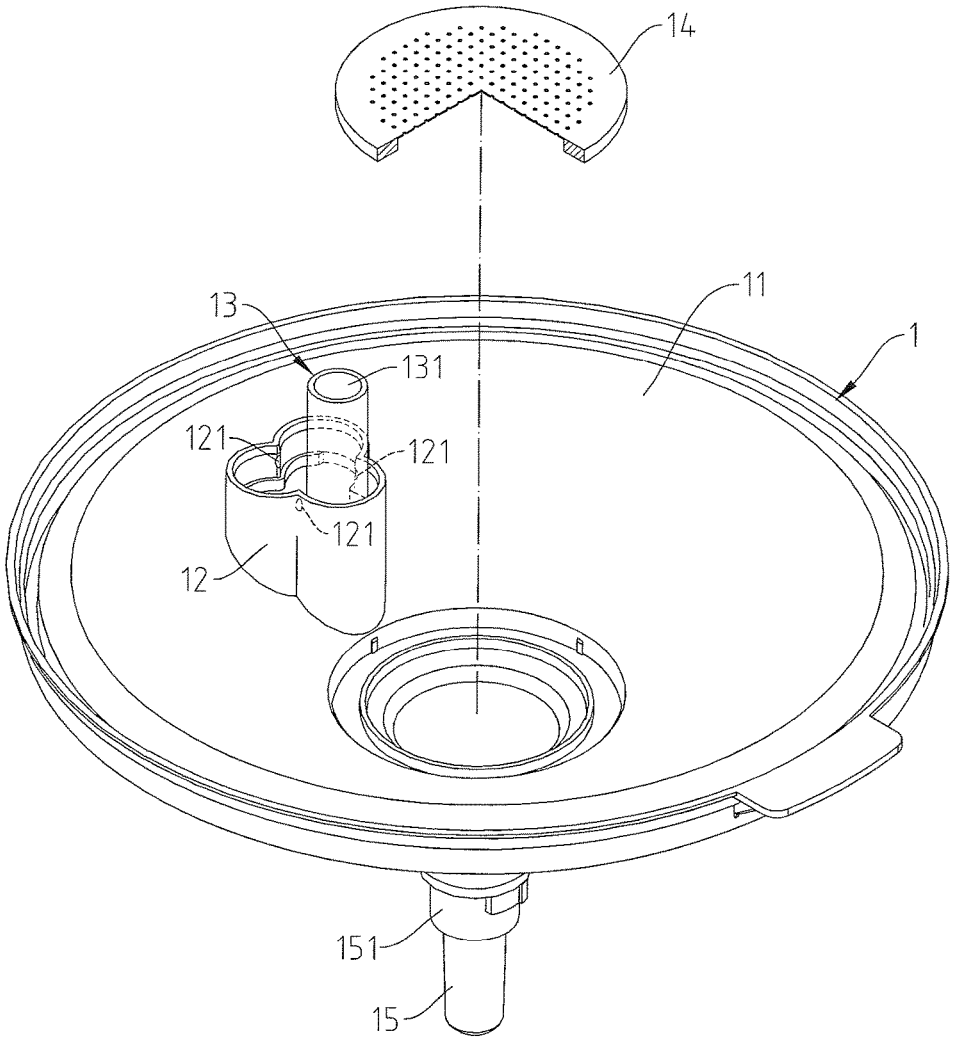
FIG. 2 is a partly exploded, perspective view of a cover of the wash-free air-guiding cover.
Figure 3:
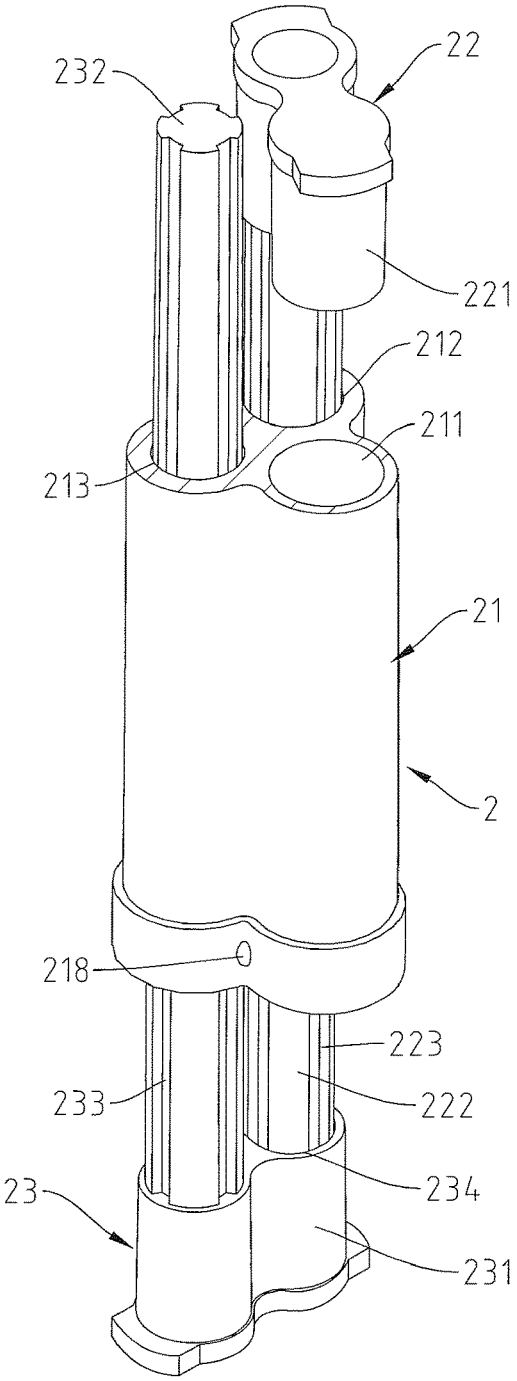
FIG. 3 is a partly cutaway, perspective view of an air guiding device of the wash-free air-guiding cover.
Figure 4:
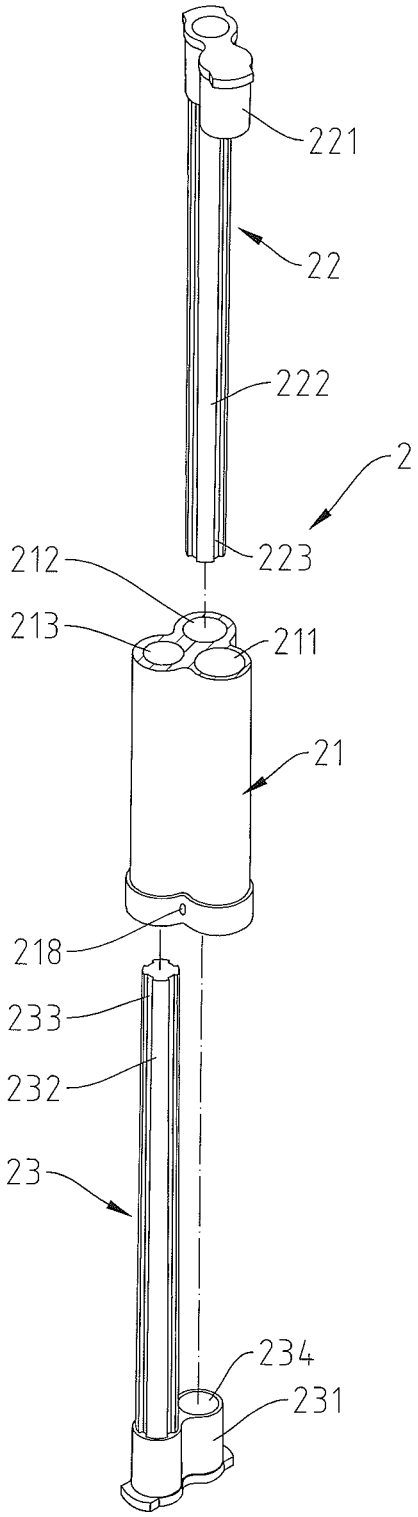
FIG. 4 is an exploded, partly cutaway, perspective view of the air guiding device of the wash-free air-guiding cover.
Figure 5:
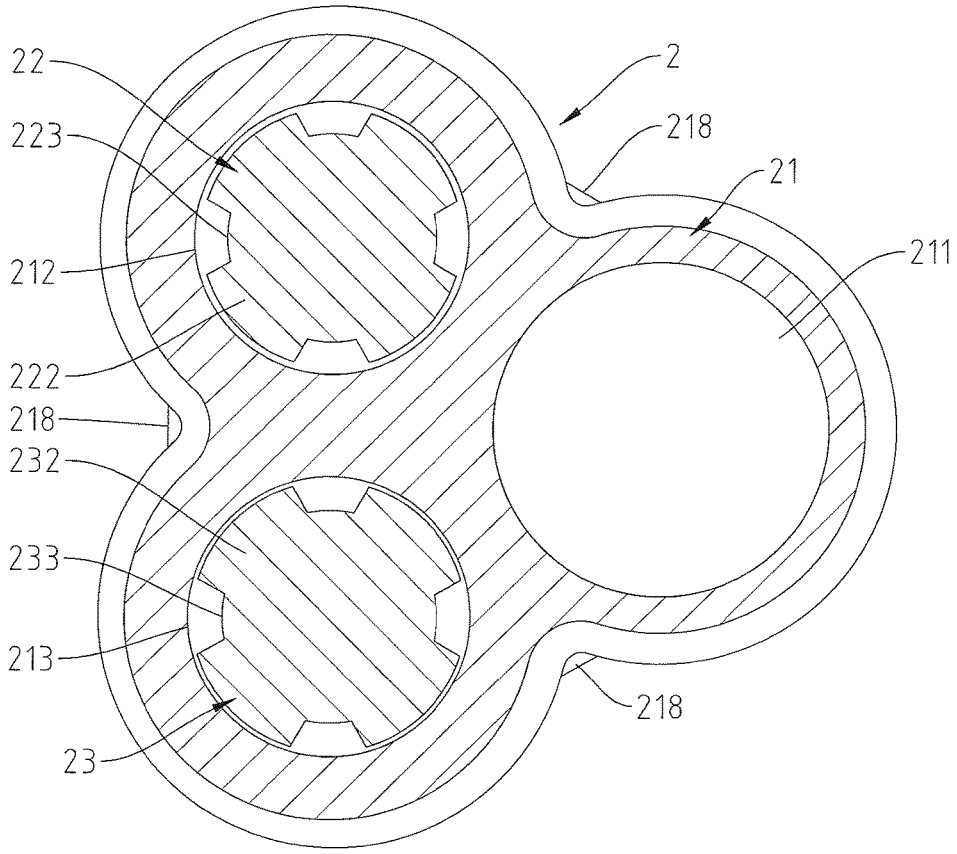
FIG. 5 is a cross sectional view of the air guiding device.
Figure 6:
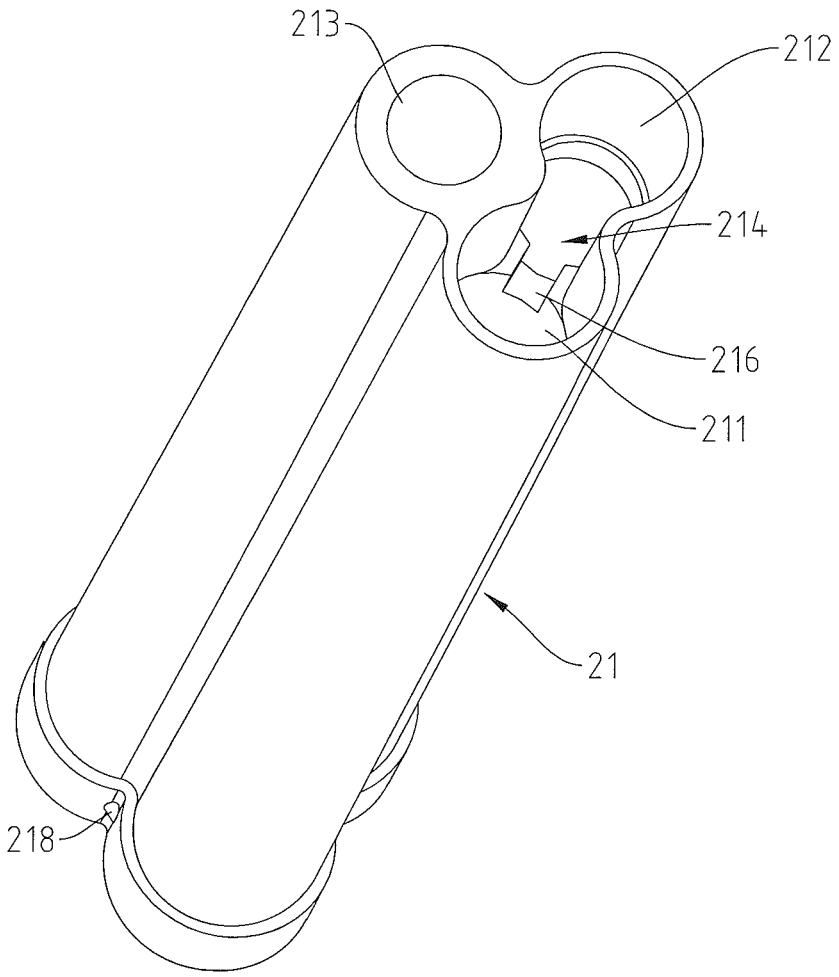
FIG. 6 is a perspective view of a tube of the air guiding device.
Figure 7:
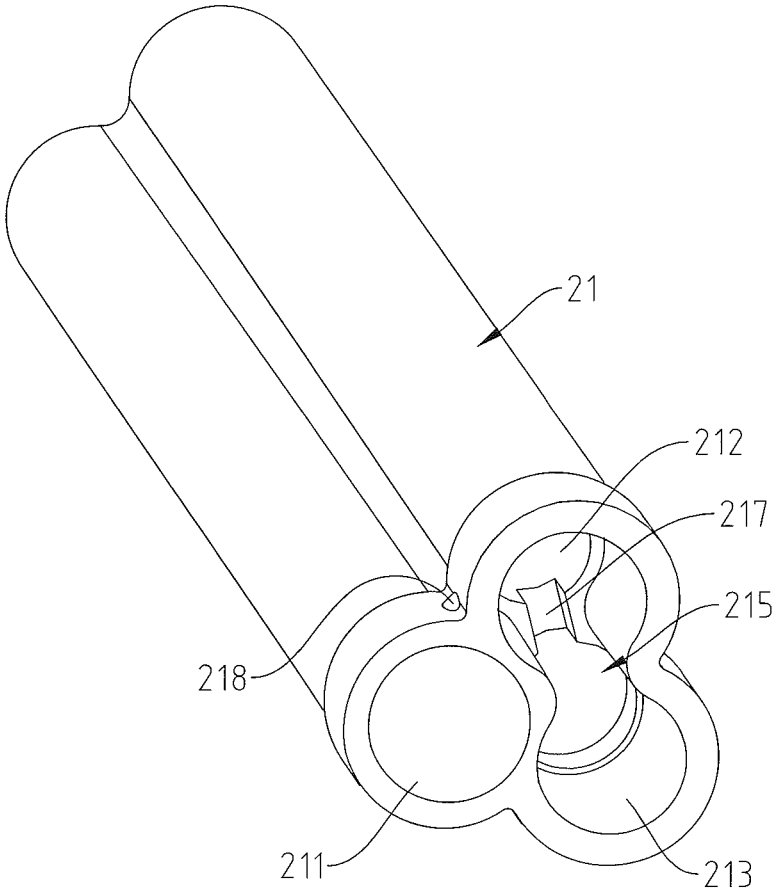
FIG. 7 is another perspective view of the tube.

With reference to FIGS. 1-8, a wash-free air-guiding cover 1 according to the present invention includes a cover 1 and an air guiding device 2. The cover 1 includes a body 11 having a first side and a second side. A fixing seat 12 is disposed on the first side of the body 11. A ventilation tube 13 extends from an inside of the fixing seat 12 and includes a ventilation hole 131 intercommunicated with the second side of the body 11. With reference to FIGS. 1, 2, 9, and 10, the cover 1 further includes a mesh filter 14 and a paint outlet tube 15 with a connecting portion 151. The fixing seat 12 of the cover 1 includes a plurality of positioning recesses 121 (FIG. 2) in an inner periphery thereof.

An end of the air guiding device 2 is mounted in the fixing seat 12 of the cover 1 by tight fitting. The air guiding device 2 includes a tube 21, a first sealing member 22, and a second sealing member 23. The tube 21 includes first and second ends and first, second, and third air guiding spaces 211, 212, and 213. Each of the first, second, and third air guiding spaces 211, 212, and 213 extends from the first end through the second end of the tube 21. The first end of the tube 21 includes a first positioning space 214 intercommunicated with the first and second air guiding spaces 211 and 212. The second end of the tube 21 includes a second positioning space 215 intercommunicated with the second and third air guiding space 212 and 213. Furthermore, the first end of the tube 21 includes a first groove 216 intercommunicated between the first and second air guiding spaces 211 and 212 and located adjacent to the first positioning space 214. Furthermore, the second end of the tube 21 includes a second groove 217 intercommunicated between the second and third air guiding spaces 212 and 213 and located adjacent to the second positioning space 215. Furthermore, the tube 21 of the air guiding device 2 includes a plurality of positioning protrusions 218 on the outer periphery thereof.

The first sealing member 22 includes a first sealing element 221 positioned in the first positioning space 214. A first flow guiding rod 222 extends from a side of the first sealing element 221 and extends into the second air guiding space 212. The first flow guiding rod 222 includes a plurality of first guiding grooves 223 disposed on an outer periphery of the first flow guiding rod 222 and annularly spaced from each other.

The second sealing member 23 includes a second sealing element 231 positioned in the second positioning space 215. A second flow guiding rod 232 extends from a side of the second sealing element 231 and extends into the third air guiding space 213. The second flow guiding rod 232 includes a plurality of second guiding grooves 233 disposed on an outer periphery of the second flow guiding rod 232 and annularly spaced from each other. The second sealing member 23 further includes a positioning hole 234 into which an end of the first flow guiding rod 222 extends.

Figure 8:
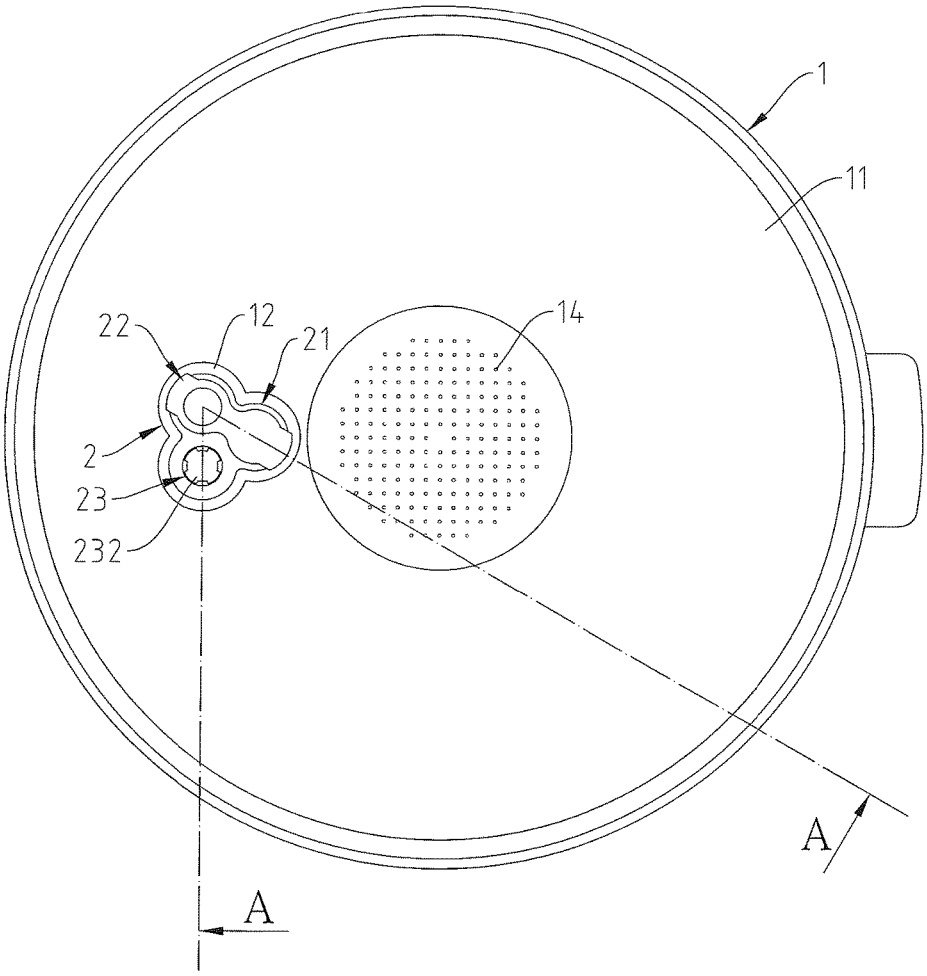
FIG. 8 is a top view of the wash-free air-guiding cover.
Figure 9:
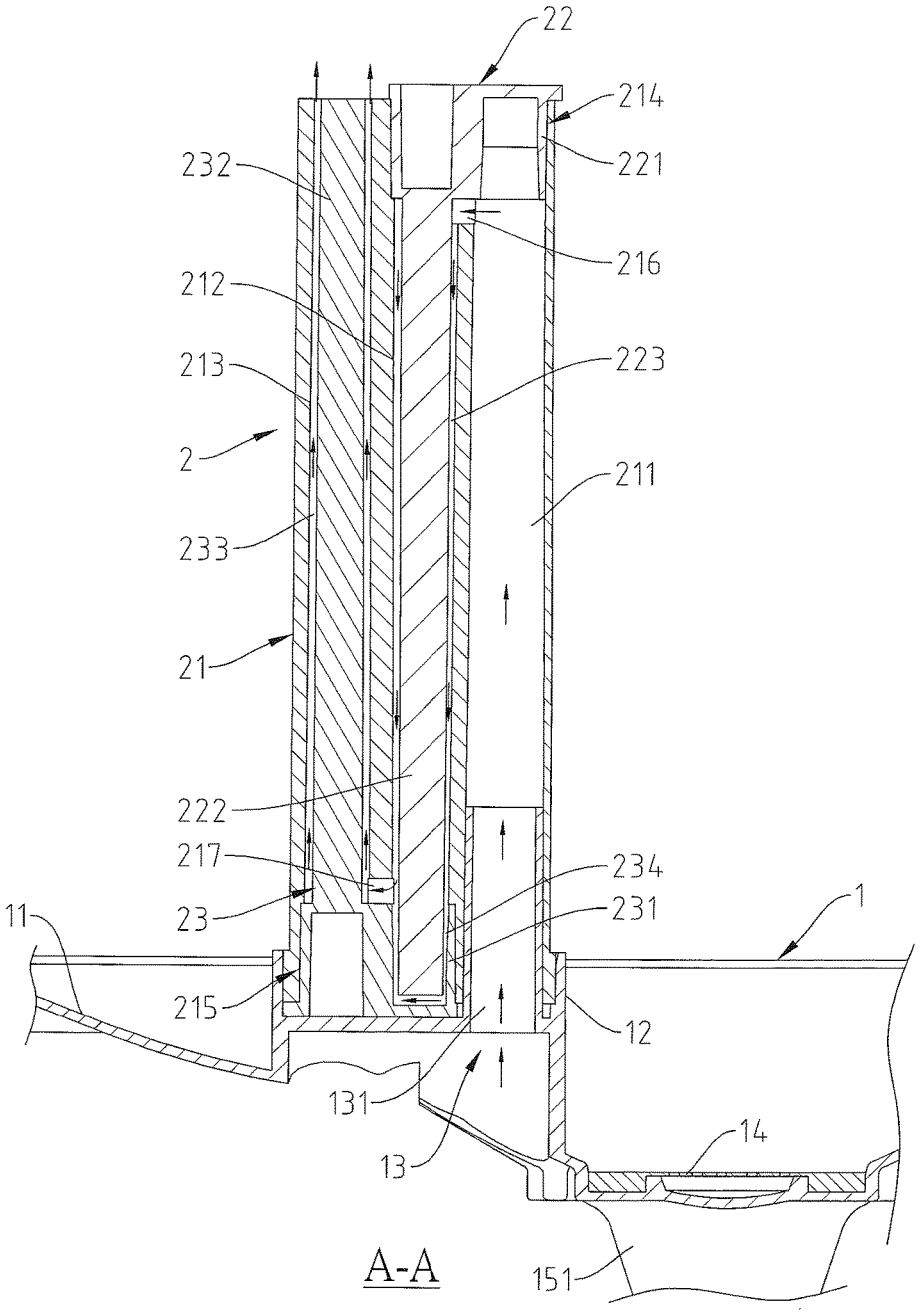
FIG. 9 is a cross sectional view taken along section line A-A of FIG. 8.

With reference to FIGS. 8 and 9, when the air guiding device 2 is connected to the fixing seat 12 of the cover 1, the ventilation tube 13 and the ventilation hole 131 of the cover 1 intercommunicates with the first air guiding space 211. Each positioning protrusion 218 of the tube 21 is engaged in one of the positioning recesses 121 of the fixing seat 12 (see FIGS. 2, 5, and 7) to avoid disengagement of the tube 21. Ambient air is permitted to enter the first air guiding space 211 via the ventilation tube 13 and the ventilation hole 131, pass through a gap between the second air guiding space 212 and the first flow guiding rod 222 via an end of the first air guiding space 211, pass through a gap between the third air guiding space 213 and the second flow guiding rod 232 via an end of the second air guiding space 212, and then flow out of an end of the third air guiding space 213.

Figure 10:
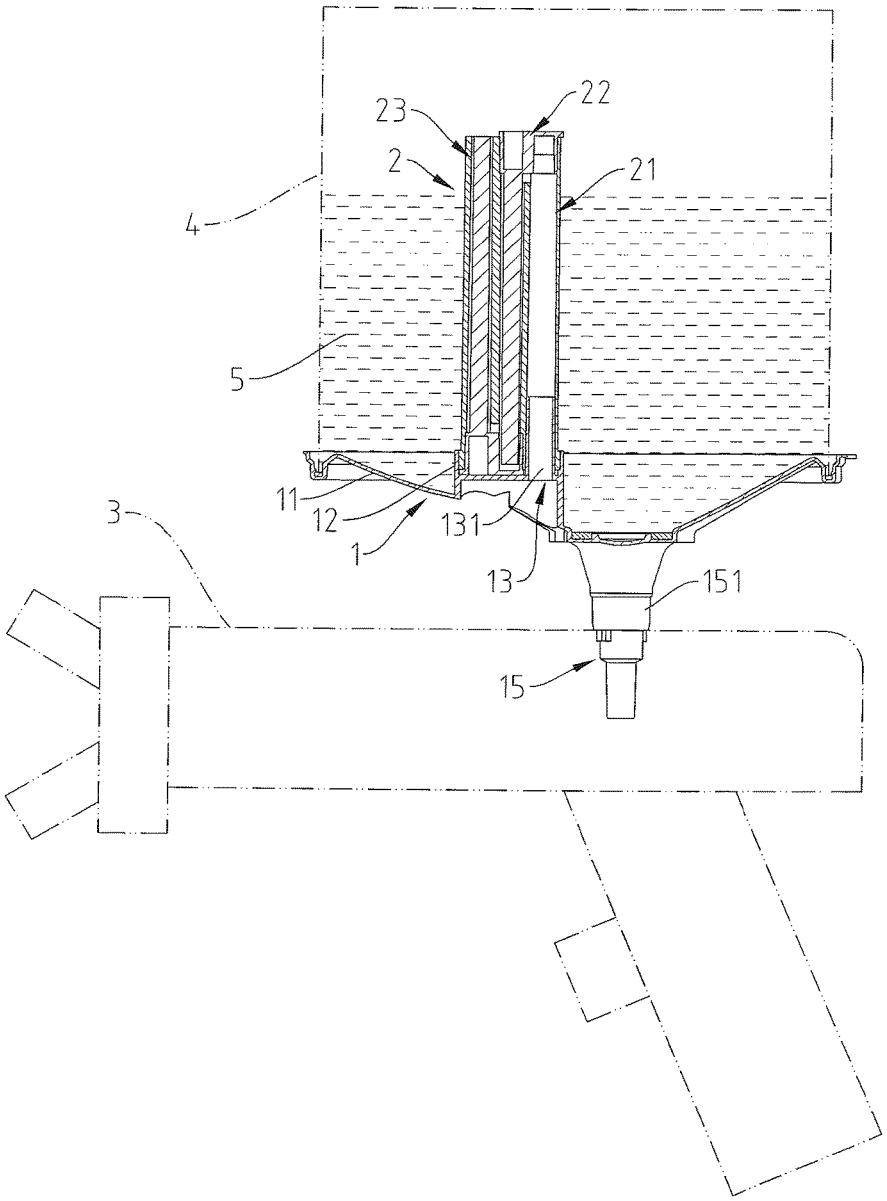
FIG. 10 is a diagrammatic view illustrating use of the wash-free air-guiding cover on a paint spray gun.

With reference to FIGS. 8-10, when the wash-free air-guiding cover 10 is used on a paint spray gun 3, a paint container 4 is coupled to the cover 1, the downwardly extending paint outlet tube 15 of the cover 1 is connected to the paint spray gun 3 by the connecting portion 151, and the air guiding device 2 is received in the paint container 4. Since ambient air flows zigzag through the first air guiding space 211 of the tube 21, the gap between the second air guiding space 212 and the first flow guiding rod 222, and the gap between the third air guiding space 213 and the second flow guiding rod 223 during operation, the paint 5 in the paint container 4 has to flow through the third air guiding space 213, the second air guiding space 212, and the first air guiding space 211 to leak through the ventilation hole 131 of the cover 1. Nevertheless, due to the small gap between the first flow guiding rod 222 and the second air guiding space 212 and the small gap between the second flow guiding rod 232 and the third air guiding space 213, the viscous paint 5 is less likely to enter between the third air guiding space 213 and the second flow guiding rod 232, assuring smooth flow of air during the painting operation and avoiding the paint 5 from leaking via the ventilation tube 13 and the ventilation hole 131 of the cover 1. Thus, the smooth flow of air permits uniform atomization of the paint 5, avoids waste of the paint 5, and increases the painting quality.

Although specific embodiments have been illustrated and described, numerous modifications and variations are still possible without departing from the scope of the invention. The scope of the invention is limited by the accompanying claims.

The invention claimed is:

1. A wash-free air-guiding cover comprising:

a cover including a body having a first side and a second side, with a fixing seat disposed on the first side of the body, with a ventilation tube extending from an inside of the fixing seat and including a ventilation hole intercommunicated with the second side of the body; and an air guiding device mounted to the fixing seat of the cover, with the air guiding device including a tube, a first sealing member, and a second sealing member, with the tube including first and second ends and first, second, and third air guiding spaces, with each of the first, second, and third air guiding spaces extending from the first end through the second end of the tube, with the first end of the tube including a first positioning space intercommunicated with the first and second air guiding spaces, with the second end of the tube including a second positioning space intercommunicated with the second and third air guiding space, with the first sealing member including a first sealing element positioned in the first positioning space, with a first flow guiding rod extending from a side of the first sealing element and extending into the second air guiding space, with the second sealing member including a second sealing element positioned in the second positioning space, with a second flow guiding rod extending from a side of the second sealing element and extending into the third air guiding space, and with the first air guiding space intercommunicated with the ventilation tube and the ventilation hole of the cover, wherein ambient air is permitted to enter the first air guiding space, pass through a gap between the second air guiding space and the first flow guiding rod via an end of the first air guiding space, pass through a gap between the third air guiding space and the second flow guiding rod via an end of the second air guiding space, and then flow out of an end of the third air guiding space.

2. The wash-free air-guiding cover as claimed in claim 1, wherein the first end of the tube of the air guiding device includes a first groove intercommunicated between the first and second air guiding spaces and located adjacent to the first positioning space.

3. The wash-free air-guiding cover as claimed in claim 2, wherein the second end of the tube of the air guiding device includes a second groove intercommunicated between the second and third air guiding spaces and located adjacent to the second positioning space.

4. The wash-free air-guiding cover as claimed in claim 1, wherein the first flow guiding rod of the air guiding device includes a plurality of first guiding grooves disposed on an outer periphery of the first flow guiding rod and annularly spaced from each other.

5. The wash-free air-guiding cover as claimed in claim 4, wherein the second flow guiding rod of the air guiding device includes a plurality of second guiding grooves disposed on an outer periphery of the second flow guiding rod and annularly spaced from each other.

6. The wash-free air-guiding cover as claimed in claim 1, wherein the fixing seat of the cover includes a plurality of positioning recesses in an inner periphery thereof, the tube of the air guiding device includes a plurality of positioning protrusions on the outer periphery thereof, and each of the plurality of positioning protrusions is engaged in one of the plurality of positioning recesses.

* * * * *